US008683835B2

(12) United States Patent
Austaller

(10) Patent No.: US 8,683,835 B2
(45) Date of Patent: Apr. 1, 2014

(54) STOP MECHANISM FOR A BENDING PRESS

(75) Inventor: Alois Austaller, Roitham (AT)

(73) Assignee: Trumpf Maschinen Austria GmbH & Co. KG, Pasching (AT)

( * ) Notice: Subject to any disclaimer, the term of this patent is extended or adjusted under 35 U.S.C. 154(b) by 917 days.

(21) Appl. No.: 12/375,066

(22) PCT Filed: Jul. 24, 2007

(86) PCT No.: PCT/AT2007/000358
§ 371 (c)(1),
(2), (4) Date: Jun. 28, 2010

(87) PCT Pub. No.: WO2008/011648
PCT Pub. Date: Jan. 31, 2008

(65) Prior Publication Data

US 2011/0048088 A1 Mar. 3, 2011

(30) Foreign Application Priority Data

Jul. 25, 2006 (AT) ..... 1259/2006

(51) Int. Cl.
*B21C 51/00* (2006.01)

(52) U.S. Cl.
USPC ..... 72/31.1; 72/461

(58) Field of Classification Search
USPC ..... 72/461, 31.01, 31.1, 420, 418, 419, 72/428, 417, 422, 389.3, 361; 83/467.1–468.94; 192/138, 148
See application file for complete search history.

(56) References Cited

U.S. PATENT DOCUMENTS 3,262,685 A 7/1966 Pike et al.
3,262,695 A * 7/1966 Fowler et al. ..... 269/317

(Continued)

FOREIGN PATENT DOCUMENTS

DE 25 25 896 12/1975
EP 0 079 138 5/1983

(Continued)

OTHER PUBLICATIONS

KGS-America, online catalogue (http://www.kgs-america.com/ca.html), "CA-134804 , Tubular type actators", Oct. 2004.*

(Continued)

*Primary Examiner* — Shelley Self
*Assistant Examiner* — Chwen-Wei Su
(74) *Attorney, Agent, or Firm* — Alston & Bird LLP

(57) ABSTRACT

The invention describes an automatic stop device (1), that can be positioned by means of a control and regulating device of a bending press, in particular an edging press, for positioning a workpiece (6) to be shaped by bending deformation between bending tools (4, 5) arranged opposite one another in a table bar (2) and a bending bar (3) adjustable in relation to the latter. It comprises a stop support slide (13) and a stop support (14) on the latter projecting substantially in perpendicular direction to a bending plane (8) formed by the bending tools (4, 5) and a stop element (15) which forms a finger section and is adjustable in a guiding arrangement (16) running perpendicular to the bending plane (8) relative to the stop support (14) between a position of rest facing the bending plane (8) and a stop position spaced apart from the latter against the effect of a spring arrangement (21). A controllable, switchable retaining device (31) is provided in order to oppose an increased adjusting resistance in the case of a stop movement of the stop element (15).

23 Claims, 4 Drawing Sheets

(56) References Cited

U.S. PATENT DOCUMENTS

| | | | | | |
|---|---|---|---|---|---|
| 4,006,623 | A | | 2/1977 | Cailloux | |
| 4,411,150 | A | | 10/1983 | Klein et al. | |
| 4,533,239 | A | * | 8/1985 | Back | 355/72 |
| 4,650,340 | A | * | 3/1987 | Krawczyk et al. | 366/220 |
| 4,761,979 | A | * | 8/1988 | Kawaguchi et al. | 72/16.2 |
| 4,831,862 | A | | 5/1989 | Ohashi et al. | |
| 5,048,816 | A | | 9/1991 | Chun et al. | |
| 5,526,672 | A | * | 6/1996 | Cain et al. | 72/461 |
| 5,555,763 | A | * | 9/1996 | Takeshita | 72/420 |
| 6,145,367 | A | * | 11/2000 | Peloquin et al. | 72/461 |
| 6,474,131 | B2 | * | 11/2002 | Torvinen et al. | 72/461 |
| 6,564,442 | B2 | | 5/2003 | Kilian et al. | |
| 6,938,454 | B2 | * | 9/2005 | Strasser et al. | 72/420 |

FOREIGN PATENT DOCUMENTS

| | | |
|---|---|---|
| EP | 1 210 995 | 6/2002 |
| JP | 10 156441 | 6/1998 |
| WO | WO 03/095125 | 11/2003 |

OTHER PUBLICATIONS

First Austrian Office Action Dated Apr. 20, 2007.

The International Search Report for PCT Application No. PCT/AT2007/000358; Filed Jul. 24, 2007; Date of Completion Nov. 15, 2007; Date of Mailing Nov. 28, 2007.

The Written Opinion for PCT Application No. PCT/AT2007/000358; Filed Jul. 24, 2007; Date of Completion Nov. 15, 2007; Date of Mailing Nov. 28, 2007.

* cited by examiner

STOP MECHANISM FOR A BENDING PRESS

BACKGROUND OF THE INVENTION

The invention relates to a stop device for a bending press.

From document WO 03/095125 A1 a stop device is known as the rear stop of a production device for bent workpieces made from sheet blanks, in particular sheet metal blanks, which in a finger support mounts a stop finger that is adjustable linearly in a direction perpendicular to a bending plane, which stop finger is adjusted against the action of a spring arrangement on supplying a workpiece to be subjected to bending deformation from a position of rest into a stop position delimited by a fixed stop. By means of a sensor element the adopted stop position is monitored and by means of a control signal a program sequence is triggered for the shaping process.

From the document U.S. Pat. No. 5,761,940 A1 a method and a device are known as a rear stop of an edging press for the automated feeding of a workpiece to be subjected to bending deformation between bending tools. According to this method and the device stop fingers projecting in the direction of the bending plane are arranged on independent stop supports driven parallel to a bending plane predetermined by the bending tools, on an angle lever pivotable on an axis running perpendicular to a standing surface of the bending press, whereby a stop force causing a pivot movement on the stop finger is measured by means of the force measuring sensor and by evaluating the measurement result in a control and regulating device the workpiece is positioned finally in relation to the bending plane.

SUMMARY OF THE INVENTION

The objective of the invention is to create a stop device for a bending press, in particular an edging press, for positioning a workpiece to be shaped between bending tools, in which the resistance to displacement of the stop element can be changed as a function of workpiece parameters.

This objective of the invention is achieved by means of a switchable and controllable retaining device that is connected with the control and regulating device, the retaining device being operable to exert an additional resistance to movement of the stop element toward the stop position, beyond the resistance provided by a usual spring arrangement for the stop element. The surprising advantage in this case is that in this way at the same time as automatically configuring the stop device according to predetermined parameters for the shaping process of the predetermined workpiece there is an adjustment of the workpiece-dependent displacement resistance of the stop element, whereby a manual refitting process becomes unnecessary and incorrect manipulations are effectively avoided.

The present application also describes certain embodiments by means of which the workpiece to be shaped is positioned to the limit stop in two dimensions with high precision for high quality shaping, further embodiments by means of which a high degree of automation and thereby a reduction in the effort of refitting is achieved, and still further embodiments by means of which an additional adjustment is made possible at the time of the initial start-up.

By means of other advantageous developments described herein, a combination of the retaining device with the mechanical adjusting device formed by the spring arrangement is achieved for returning the stop element from a stop position into a position of rest.

Furthermore, an embodiment is also described, by means of which a very small configuration of the stop device is achieved.

Other advantageous developments described herein simplify the design of the stop element and in this way the workpiece is positioned precisely for the shaping process.

According to further embodiments described herein a fine adjustment is possible of the rest and stop positions, affecting both the linear displacement of the stop element and the pivoting displacement, by means of a single fine positioning at the time of the initial start-up, as well as a pivot movement an increased resistance can be set to a displacement range by at least one retaining means in order to avoid an unintentional pivoting movement.

Lastly, developments are also described herein by means of which an exact delimitation of all end positions is achieved and a final adjustment is ensured by means of fine adjustment.

BRIEF DESCRIPTION OF THE DRAWINGS

For a better understanding of the invention the latter is explained in more detail with reference to the exemplary embodiments shown in the Figures.

DETAILED DESCRIPTION OF THE DRAWINGS

Figure 1:
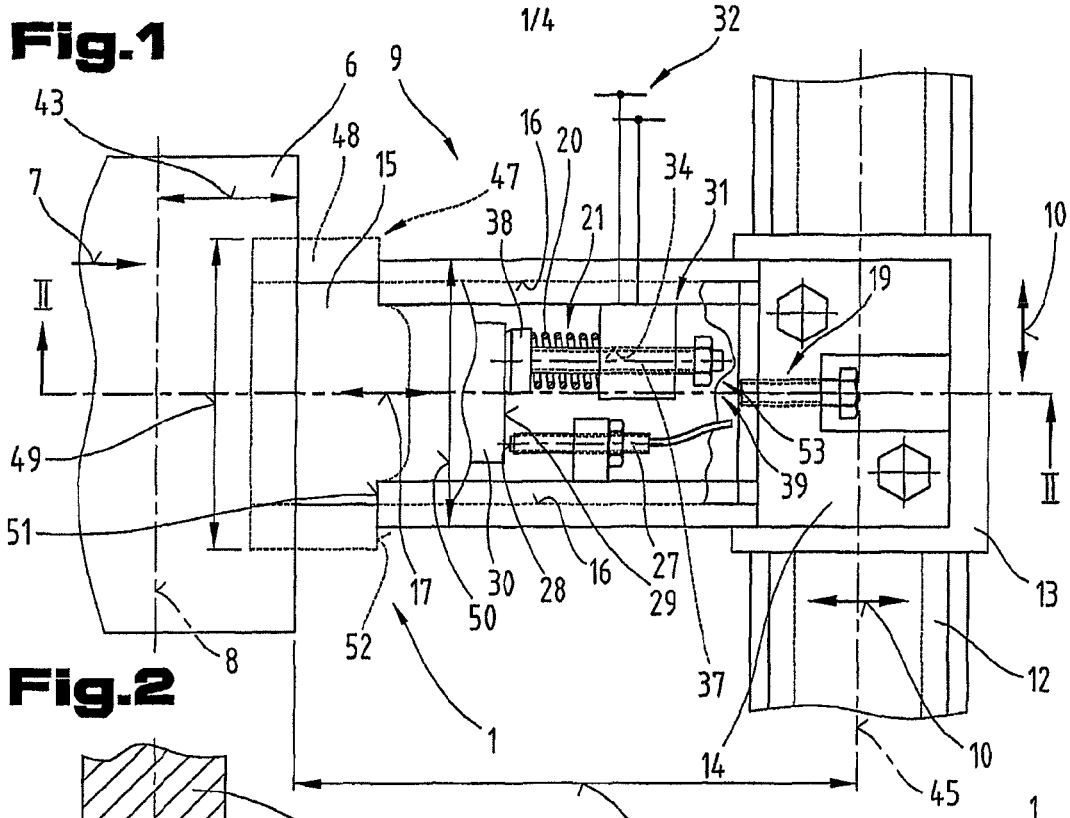
FIG. 1 shows a stop device according to the invention, in cross section along the lines I-I in FIG. 2.

First of all, it should be noted that in the variously described exemplary embodiments the same parts have been given the same reference numerals and the same component names, whereby the disclosures contained throughout the entire description can be applied to the same parts with the same reference numerals and same component names. Also details relating to position used in the description, such as e.g. top, bottom, side etc. relate to the currently described and represented figure and in case of a change in position should be adjusted to the new position. Furthermore, also individual features or combinations of features from the various exemplary embodiments shown and described can represent in themselves independent or inventive solutions.

Figure 2:
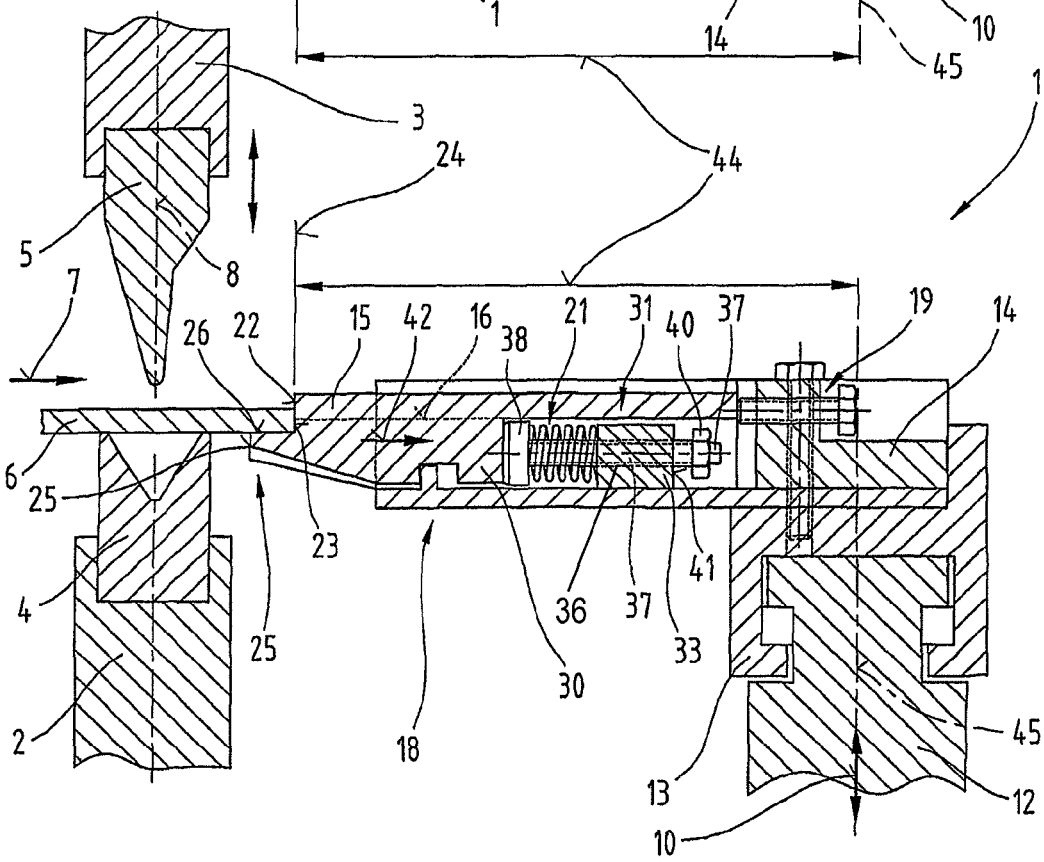
FIG. 2 shows the stop device, in cross section along the lines II-II in FIG. 1.

In FIGS. 1 and 2 a stop device 1 is shown, for positioning a workpiece 6, in a not shown edging press, to be shaped by bending deformation between bending tools 4, 5 arranged opposite one another in a table bar 2 and a bending bar 3 that is displaceable relative thereto.

The stop device 1 forms a so-called rear stop, which in the insertion direction of the workpiece 6—according to arrow 7—is arranged displaceably behind a bending plane 8 defined by the position of the bending tools 4, 5 in a press chamber 9, preferably in three dimensions—according to double arrow 10.

In this way the stop device 1 can be displaced into the required position according to the fitting of the table bar 2 and bending bar 3, whereby for the displacement non-illustrated drive devices and control means are provided and the positioning takes place automatically many times by means of the programme sequence for each different bending process.

The stop device 1 consists of a stop support slide 13 which can be driven on a linear guide 12, on which a stop support 14 is secured projecting in the direction of the bending plane 8 and which in a linear guiding arrangement 16 displaceably mounts a stop element 15 in a direction perpendicular to the bending plane 8—according to double arrow 17—between a front position of rest delimited by a stop means 18 and a rear stop position delimited by a stop means 19.

In the exemplary embodiment shown the stop element 15 is after the insertion of the workpiece 6 against the action of a spring arrangement 21 formed by a compression spring 20, in its stop position on the stop means 19, which forms an adjustable fixed stop. The workpiece 6 is pushed for this during the insertion process against a bearing face 22 of the stop element 15 with an end face 23 until the stop position is reached. In this way the end face 23 is aligned precisely in a stop plane 24 running parallel to the bending plane 8 in order to perform the bending deformation on the workpiece 6 exactly parallel to the end face 23.

An end section 25 of the stop element 15 facing the bending plane 8 is graduated in a step-like manner, whereby a bearing surface 26 aligned perpendicular to the bending plane 8 is formed on the stop element 15. At right angles thereto is a further bearing surface 25 lying closer to the bending plane 8 for stopping the workpiece 6, which is used when the end face 23 projects only slightly over the bending tool 4.

The stop support 14 comprises in a recess formed between the guiding arrangements 16 a sensor element 27, i.e. a proximity sensor, which with an end face 28 faces an end face 29 of the a base part 30 of the stop element 15, so that the adopted stop position of the stop element 15 is detected. Preferably, the sensor element 27 is secured adjustably in the direction of displacement according to double arrow 17—of the stop element 15 on the stop support 14.

Furthermore, in the recess a retaining device 31, consisting of a magnetic coil 33 chargeable with electrical energy from an energy source 32, is arranged with a bolt-like coil armature core 34, which passes through the magnet coil 33 in a bore 36 with a cylinder pin 37 and with the base part 30 of the stop element 15 comprises a pressure head 38 cooperating with the end face. Between the pressure head 38 and the magnet coil 33 the cylinder pin 37 is surrounded by the pretensioned compression spring 20, whereby the stop element 15 in a position of rest is positioned in a front position of rest facing the bending plane 8.

The cylinder pin 37 has at one end 39 opposite the pressure head 38 a support flange 40, on which as soon as a magnetic field is produced, bears on an end face 41 of the magnetic coil 33 and thus depending on the magnetic field strength opposes a variable resistance of a movement of the coil armature core 34 and thus a movement of the stop element 15.

Also by means of an annular ring surface projecting over the cylinder pin 37 the coil armature core 34 is supported on the end face 41 of the magnet coil 33 and thus a displacement path of the stop element 15 is determined via the fixed front end position owing to the effect of the compression spring 20 in addition to the stop means 18.

By means of the retaining device 31 formed by the magnet coil 33 and the coil armatures 34 on the one hand resistance opposing a stop movement of the stop element—according to arrow 42—can be controlled by the pretensioning force of the compression spring 20 and also if necessary by charging the magnet coil 33 with current from the energy source 32, whereby the magnetic field strength can be controlled by changing the current strength or the voltage.

Thus depending on a frictional force exerted by the workpiece 6 on the stepping of the stop element 15, when inserting the workpiece 6, a displacement of the stop element 15—according to arrow 42—is opposed, and thus a displacement of the stop element 15 is effectively prevented, before the workpiece 6 comes to bear with its end face 23 on the bearing surface 22, even in the case of a heavy workpiece 6 or with a high coefficient of friction caused by a rough surface of the workpiece. If however light workpieces or workpieces with sliding surfaces, in particular thin, blank metal sheets are subjected to the bending process the action of the retaining device can be dispensed with.

The described stop device is used as a so-called fixed stop for aligning the end face 23 of the workpiece 6 on supplying along an X-axis, whereby the stop element 15 in the stop position is displaced against the stop means, at which a defined spacing 43 of the bending plane 8 from the stop plane 24 is achieved. This is monitored by the sensor element 27 by means of which on establishing the reached stop position of the stop element 15 a control signal at a control device of the edging press is started for introducing the shaping process by controlling the drive means of the edging press.

As the spacing 43 depending on the workpiece 6 and thus a provided edging height has a different size, but a distance 44 between the stop plane in the inserted state of the stop element 15 and a longitudinal central axis of the linear guide 12 has structural predefined size, the linear guide 12, on which the stop support slide 13 is arranged displaceably—according to double arrow 10—in a direction perpendicular to the bending plane 8—according to arrow 10.

Also a further design of a fixed stop 47 between the stop element 15 and the stop support 14 is shown by broken lines, which is formed in that a finger section 48 of the stop element 15 has a greater width 49, than a width 50 of the stop support 14, whereby opposite end faces 51, 52 of the finger section 48 and the stop support 14 form said fixed stop 47, which in this shown exemplary embodiment is not adjustable, unlike the exemplary embodiment with the fixed stop 19 described above.

It should also be mentioned that the stop device 1 described above with workpieces 6 with a greater expansion on the edging press are used in pairs, in order to achieve a greater support width between the stop elements 15. With such an arrangement the sensor elements 27 of the parallel aligned stop devices 1 are used for a final adjustment of the workpiece 6, for example on a gripper head of a handling axis for positioning the end face 23 of the workpiece 6 exactly parallel to the bending plane 8. If the end face 23 is moved in an oblique position to the bending plane 8 against the end stop, for example only by a sensor element 27, a signal is sent to the control device of the edging press and the position is corrected by a rotational movement of the gripper head until there is a signal of the sensor element 27 of the further stop device 1. Once this position has been reached there is an adjustment in the direction of the X-axis to the end stop.

Figure 3:
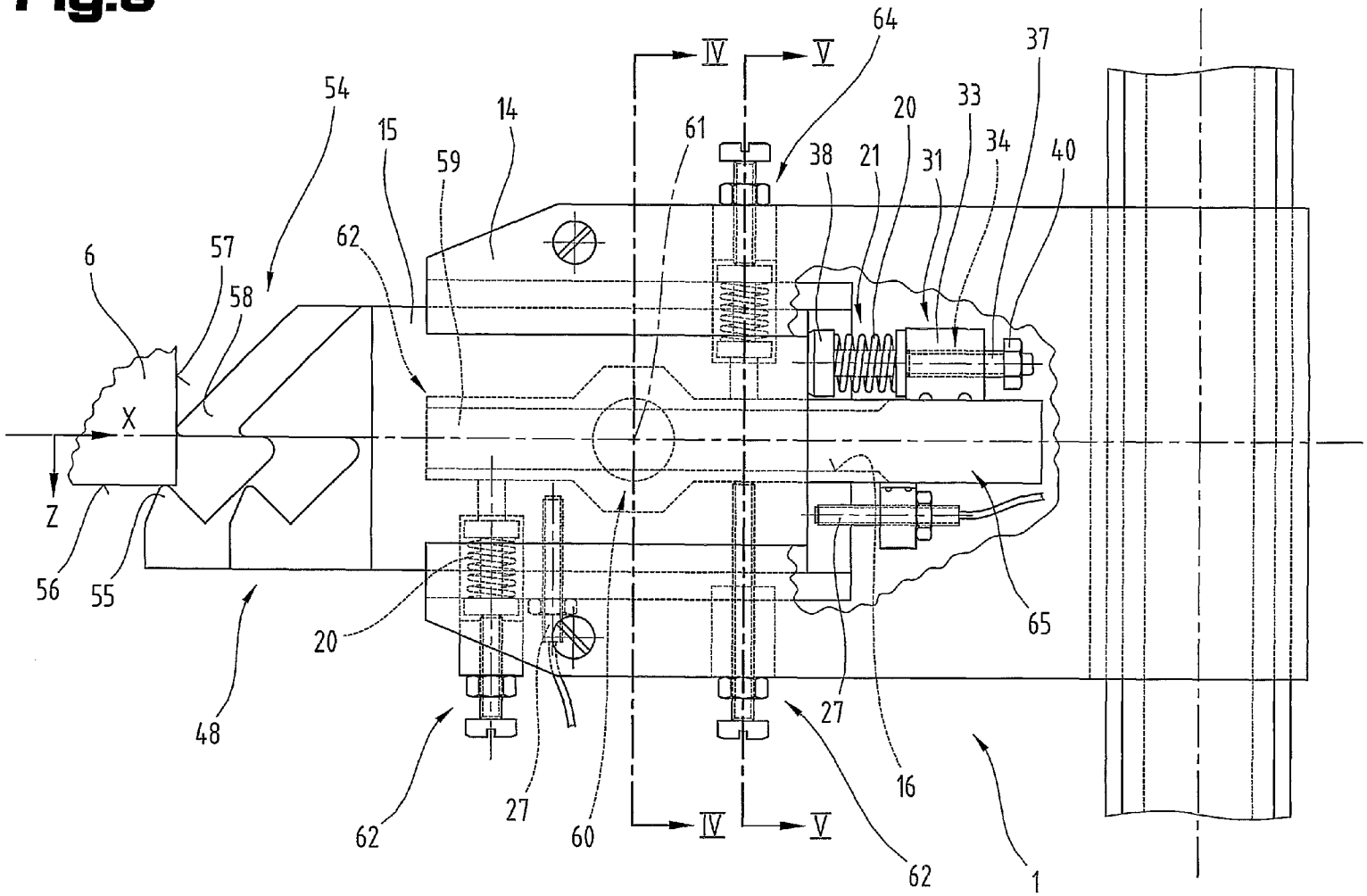
FIG. 3 shows another embodiment of the stop device in plan view.
Figure 5:
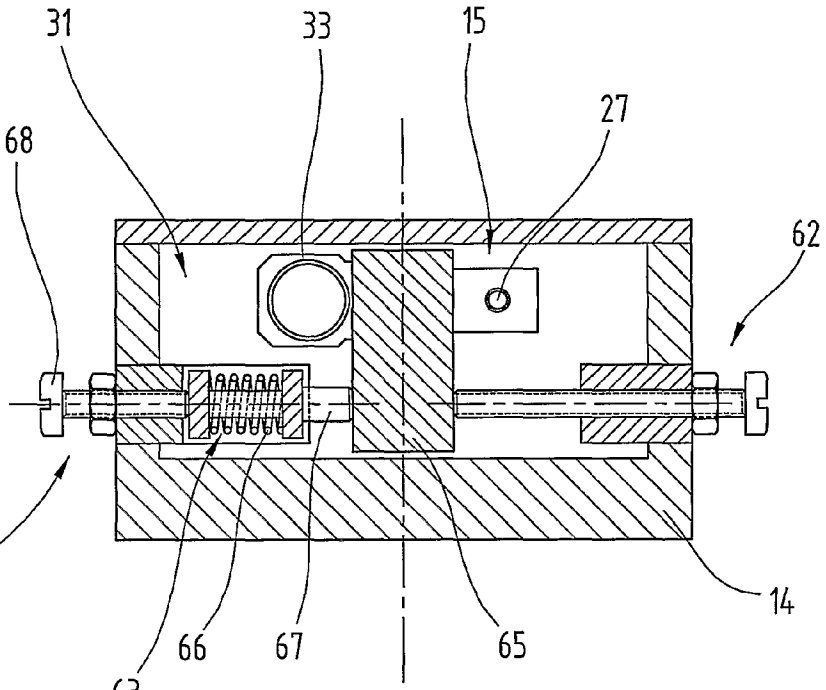
FIG. 5 shows the stop device, in cross section along the lines V-V in FIG. 3.
Figure 4:
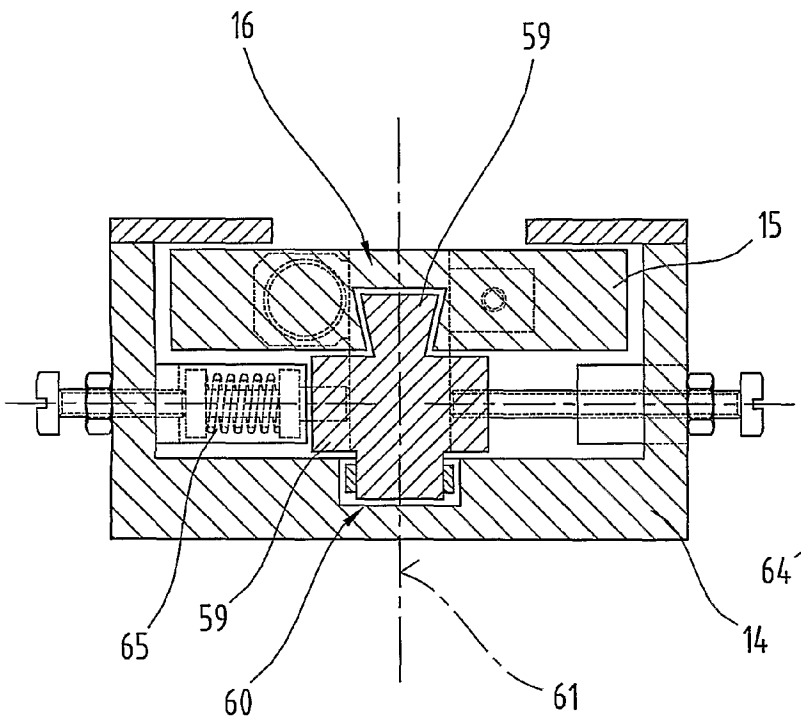
FIG. 4 shows the stop device, in cross section along the lines IV-IV in FIG. 3.

In FIGS. 3 to 5 a further embodiment of the stop device 1 according to the invention is shown. The stop device 1 is provided for positioning the workpiece 6 in two dimensions that are at right angles to one another, usually defined as the X-axis and Z-axis. For this the finger section 48 of the stop element 15 is designed as a double finger 54. This allows the workpiece 6 to stop on a projecting finger 55 with a transverse side edge 56 and with a longitudinal side edge 57 on a further finger 58, whereby the fingers 55, 58 are in a fixed dimensional relationship to one another.

For both dimensions the stop element 15 can be displaced independently from the position of rest into the stop position.

In the direction of the X-axis the stop element 15 is displaceable substantially in a direction perpendicular to the bending plane 8 in the guiding arrangement 16, which is formed for example by a linear guiding element 59, e.g. flat track, sliding guide, round rod guiding or recirculating ball guiding element etc. In the direction of the Z-axis the displaceability is achieved by mounting the guiding arrangement 16 or the guiding element 59 in a pivot bearing arrangement 60 on the stop support 14. A pivot axis 61 of the pivot bearing arrangement 60 thus runs parallel to the bending plane 8 and perpendicular to the bearing surface 26 for the workpiece 6 in the finger section 48 of the stop element 15.

In both dimensions the stop position is indicated by fixed stops 62, which can be formed for example by a delimitation of a guiding length of the guiding arrangement 16 or can be adjustable, e.g. by means of adjusting screws.

As already described in the preceding examples, the stop positions, as well as the linear displacement and also the pivot displacement are monitored by sensor elements 27, e.g. proximity sensors and form reference values for the position of the workpiece 6, which are stored in the control and monitoring device of the edging press or a data memory.

For the linear displacement in addition to the spring arrangement 21 formed by the compression spring 20, by means of which the stop element 15 is positioned in the position of rest, and which produces a first displacement resistance, for increasing the displacement resistance if necessary the retaining device 31 already described in the preceding Figures is provided with the magnet coil 33 and the coil-armature core 34.

For the pivoting movement also in addition to a compression spring 20, for example in connection with a stop means, a spring arrangement 63 is provided as the retaining device 64, which increases the displacement resistance if necessary.

The latter consists of pressure bolt 67 which is spring-loaded by a compression spring 66 acting on the pivotable guiding arrangement 16 or a pivot base 65 comprising the guiding element 59, whereby the spring force of the compression spring 66 can be adjusted by means of an adjusting screw 68.

According to a further exemplary embodiment said retaining device 64, can be used in a tandem design, with two parallel pressure bolts 67 and one compression spring 66 respectively, thus achieving a multi-stage adjustment of the displacement resistance e.g. in three stages if compression springs of varying strength are used.

It is also noted that said described stop device 1, with the possibility of stopping in two dimensions, is preferably used on a bending press in pairs for positioning the workpiece 6 on a bending press and that the stop device is preferably positioned automatically. By being used in pairs usually the workpiece 6 is aligned in the so-called Z-axis only on one of the stop devices 1, whereby in the X-axis both are used, and from the measurement results of the sensor elements 27 an exact alignment of the workpiece 6 in relation to a given bending line is achieved which does not necessarily need to run parallel to the bending plane 8.

Figure 6:
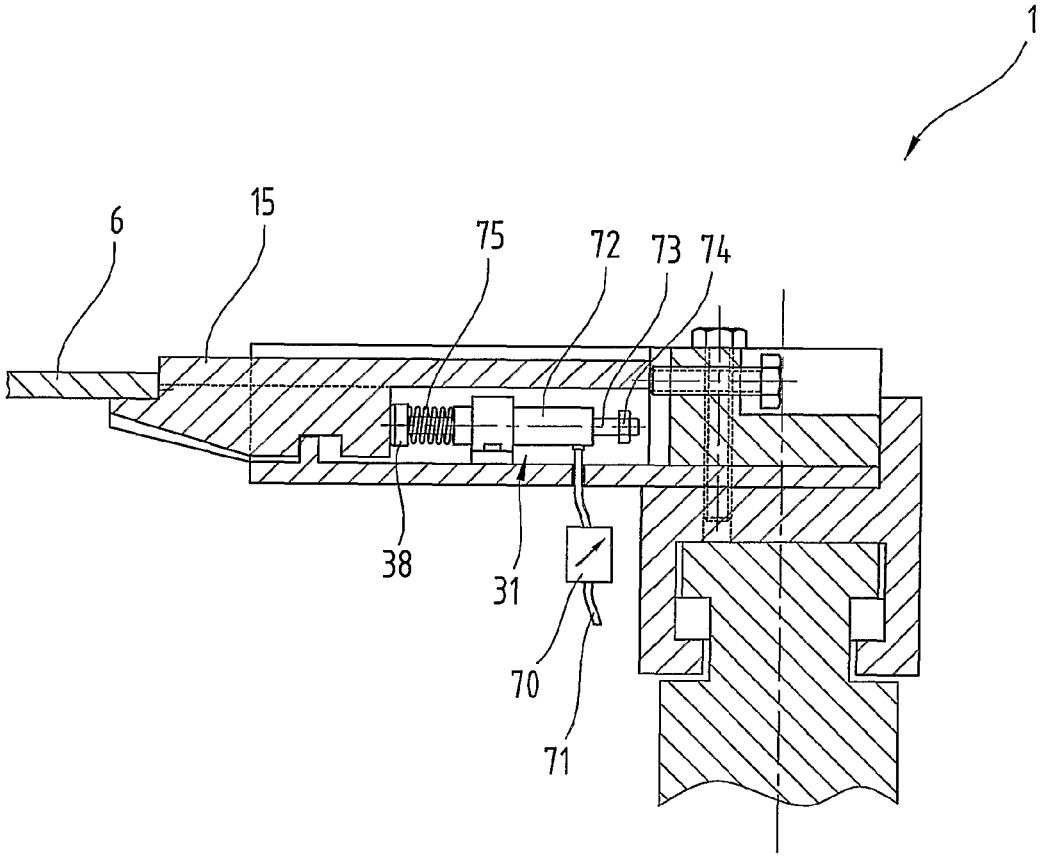
FIG. 6 shows a further embodiment of the stop device, in cross section.

FIG. 6 shows a further embodiment of the stop device 1 in which the retaining device 31 is formed for example by an adjusting means 72 that can be charged with a pressure medium, e.g. compressed air, pressure oil etc., preferably by means of a pressure control element 70, with variable pressure from a supply line 71, in the exemplary embodiment shown—a pressure cylinder. The pressure cylinder is secured onto the stop support 14 in working direction aligned parallel to the displacement direction of the stop element 15 and preferably has a continuous piston rod 73 which is provided with the pressure head 38 facing the stop element 15. In the projecting further end section the piston rod 73 for the purpose of limiting the stroke is provided with an adjusting nut 74. By arranging a compression spring 75 surrounding the piston rod 73 between the pressure head 38 and an end face of the cylinder casing of the pressure cylinder a preloading acting against the displacement of the stop element 15 is reached according to the spring dimensions. If necessary, particularly with a larger bearing weight of the workpiece 6, in order to counteract a premature, friction-dependent displacement of the stop element 15 in the pressure cylinder by supplying the pressure medium pressure is built up which can be controlled as required by means of the control element 70.

All of the details relating to value ranges in the present description are defined such that the latter include any and all part ranges, e.g. a range of 1 to 10 means that all part ranges, starting from the lower limit of 1 to the upper limit 10 are included, i.e. the whole part range beginning with a lower limit of 1 or above and ending at an upper limit of 10 or below, e.g. 1 to 1.7, or 3.2 to 8.1 or 5.5 to 10.

The exemplary embodiments show possible embodiment variants of the stop device, whereby it should be noted at this point that the invention is not restricted to the embodiment variants shown in detail, but rather various different combinations of the individual embodiment variants are possible and this variability, due to the teaching on technical procedure, lies within the ability of a person skilled in the art in this technical field. Thus all conceivable embodiment variants, which are made possible by combining individual details of the embodiment variants shown and described, are also covered by the scope of protection.

Finally, as a point of formality, it should be noted that for a better understanding of the structure of the stop device the latter and its components have not been represented true to scale in part and/or have been enlarged and/or reduced in size.

The underlying problem of the independent solutions according to the invention can be taken from the description.

Mainly the individual embodiments shown in FIGS. 1, 2; 3, 4; 5 and 6 can form the subject matter of independent solutions according to the invention. The objectives and solutions according to the invention relating thereto can be taken from the detailed descriptions of these figures.

The invention claimed is:

1. An automatic stop device (1) for positioning a workpiece to be shaped in an edging press, the edging press having bending tools (4, 5) respectively arranged opposite one another in a table bar (2) and a bending bar (3) movable relative to each other in a bending plane (8), the edging press further having a control and regulating device, the automatic stop device comprising:

a stop support slide (13) and a stop support (14) on the stop support slide (13), the stop support (14) projecting in a direction substantially perpendicular to the bending plane (8) formed by the bending tools (4, 5);

a stop element (15) and a guiding arrangement (16) for the stop element (15), the guiding arrangement (16) being structured and arranged to permit the stop element (15) to move relative to the stop support (14) in a direction perpendicular to the bending plane (8), between a position of rest facing the bending plane (8) and a stop position spaced apart therefrom;

a spring arrangement (21) that exerts a resistance force on the stop element (15) opposing movement of the stop element from the rest position toward the stop position;

at least one sensor element (27) detecting when the stop element (15) has reached the stop position; and a switchable and controllable retaining device (31) connected with the control and regulating device and operable on demand to produce an additional resistance force acting on the stop element (15) opposing movement of the stop element (15) toward the stop position, the retaining device (31) thus being operable for varying a total amount of resistance force opposing movement of the stop element (15) toward the stop position.

2. The automatic stop device (1) according to claim 1, characterised in that the retaining device (31) is arranged on the stop support (14).

3. The automatic stop device (1) according to claim 1, characterised in that the retaining device (31) is arranged on the stop element (15).

4. The automatic stop device (1) according to claim 1, characterised in that the guiding arrangement (16) for the stop element (15) is mounted pivotably on the stop support (14) by means of a pivot bearing arrangement (60).

5. The automatic stop device (1) according to claim 4, characterised in that a guiding element (59) of the guiding arrangement (16) and the retaining device (31) are arranged on a pivot base (65) of the pivot bearing arrangement (60).

6. The automatic stop device (1) according to claim 4, characterised in that a pivot axis (61) of the pivot bearing arrangement (60) runs parallel to the bending plane (8) and perpendicular to a bearing surface (26) of the stop element (15).

7. The automatic stop device (1) according to claim 1, characterised in that the retaining device (31) is formed by a magnet coil (33) which can be exposed to electrical energy from an energy source, and a bolt-like coil armature core (34) acting on the stop element (15) against movement of the stop element (15) toward the stop position.

8. The automatic stop device (1) according to claim 7, characterised in that the strength of the magnetic field generated by the magnet coil (33) can be controlled.

9. The automatic stop device (1) according to claim 7, characterised in that the magnet coil (33) is positioned in a bearing means in a direction running parallel to an adjustment direction of the stop element (15).

10. The automatic stop device (1) according to claim 7, characterised in that a compression spring (20) of the spring arrangement (21) is arranged between a pressure head (38) of the coil armature core (34) and the magnet coil (33) facing a bearing surface (25) on the stop element (15).

11. The automatic stop device (1) according to claim 10, characterised in that the coil armature core (34) is provided at one end opposite the pressure head (38) with a support flange (40) supported on an end face (41) of the magnet coil (33) opposite the action of the compression spring (20).

12. The automatic stop device (1) according to claim 11, characterised in that the support flange (40) is secured adjustably in the direction of the length of the coil armature core (34) on the latter.

13. The automatic stop device (1) according to claim 1, characterised in that the retaining device (31) is formed by an adjusting means (72) supplied with a pressure medium.

14. The automatic stop device (1) according to claim 1, characterised in that a finger section (48) of the stop element (15) facing the bending plane (8) is designed in the form of a double finger (54).

15. The automatic stop device (1) according to claim 14, characterised in that the double finger (54) forms two stop planes running at right angles to one another, one stop plane being aligned parallel to the bending plane (8).

16. The automatic stop device (1) according to claim 5, characterised in that a pivot movement of the stop element (15) in a stop position is delimited by an adjustable stop means on the stop support (14).

17. The automatic stop device (1) according to claim 16, characterised in that the stop means acting against the pivot movement is provided with an adjusting means that is pretensioned by a compression spring (21).

18. The automatic stop device (1) according to claim 17, characterised in that acting against the pivot movement in addition to the stop means at least one retaining means (64) is arranged on the stop support (15) or the pivot base (65).

19. The automatic stop device (1) according to claim 18, characterised in that the retaining means (64) is formed by a pressure bolt (67) guided linearly in a housing and pretensioned by a compression spring (66).

20. The automatic stop device (1) according to claim 19, characterised in that the spring force of the compression spring (66) is adjustable.

21. The automatic stop device (1) according to claim 5, wherein the sensor element (27) is arranged on the stop support (14) or the stop element (15) for detecting a stop position of the pivoting movement.

22. The automatic stop device (1) according to claim 5, characterised in that between the stop support (14) and the stop element (15) or the pivot base, adjustable fixed stops (62) are arranged for delimiting the pivot movement between a position of rest and the stop position.

23. The automatic stop device (1) according to claim 1, characterised in that the guiding arrangement (16) is provided with stop means (18, 19) defining the rest and stop positions of the stop element (15) with respect to the direction of movement perpendicular to the bending plane (8).

* * * * *

UNITED STATES PATENT AND TRADEMARK OFFICE

CERTIFICATE OF CORRECTION

PATENT NO. : 8,683,835 B2
APPLICATION NO. : 12/375066
DATED : April 1, 2014
INVENTOR(S) : Alois Austaller It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1438 days.

Signed and Sealed this
Twenty-ninth Day of September, 2015

Michelle K. Lee

Michelle K. Lee
*Director of the United States Patent and Trademark Office*